US007268529B2

(12) United States Patent
Mochizuki et al.

(10) Patent No.: US 7,268,529 B2
(45) Date of Patent: Sep. 11, 2007

(54) REFERENCE VOLTAGE GENERATING CIRCUIT, A SEMICONDUCTOR INTEGRATED CIRCUIT AND A SEMICONDUCTOR INTEGRATED CIRCUIT APPARATUS

(75) Inventors: Toshio Mochizuki, Tokyo (JP); Eiki Imaizumi, Tokyo (JP); Sachiko Okumura, Tokyo (JP)

(73) Assignee: Renesas Technology Corp., Tokyo (JP)

( * ) Notice: Subject to any disclaimer, the term of this patent is extended or adjusted under 35 U.S.C. 154(b) by 0 days.

(21) Appl. No.: 11/515,954

(22) Filed: Sep. 6, 2006

(65) Prior Publication Data

US 2007/0052405 A1 Mar. 8, 2007

(30) Foreign Application Priority Data

Sep. 7, 2005 (JP) ..... 2005-258870
Jun. 19, 2006 (JP) ..... 2006-168393

(51) Int. Cl.
*G05F 3/22* (2006.01)
*G05F 3/26* (2006.01)

(52) U.S. Cl. ..... 323/316; 323/314

(58) Field of Classification Search ..... 323/313–316; 327/539

See application file for complete search history.

(56) References Cited

U.S. PATENT DOCUMENTS 4,633,165 A * 12/1986 Pietkiewicz et al. ..... 323/314
5,581,174 A * 12/1996 Fronen ..... 323/316
6,111,396 A * 8/2000 Lin et al. ..... 323/313
7,019,584 B2 * 3/2006 Bartel et al. ..... 327/539
7,088,085 B2 * 8/2006 Marinca ..... 323/314

FOREIGN PATENT DOCUMENTS

JP 2004-206633 7/2004

* cited by examiner

*Primary Examiner*—Gary L Laxton
(74) *Attorney, Agent, or Firm*—Mattingly, Stanger, Malur & Brundidge, P.C.

(57) ABSTRACT

The present invention provides a band gap type reference voltage generating circuit and a semiconductor integrated circuit having the same, capable of generating a reference voltage of about 1.2V or less whose temperature dependency is low, and realizing reduced offset voltage dependency of a differential amplifier. A band gap part has: a first resistor and a first bipolar transistor connected in series between power supply voltage terminals; a second resistor, a second bipolar transistor, and a third resistor connected in series between the power supply voltage terminals; and a differential amplifier that receives voltages generated by the first and second resistors, and an output of the differential amplifier is applied to the bases of the two transistors. The output part has a third bipolar transistor having a base to which the output of the differential amplifier is applied, a fourth resistor connected in series with the third bipolar transistor, a current mirror circuit for transferring current flowing in the third bipolar transistor, and a fifth resistor and a diode for converting the transferred current to voltage.

16 Claims, 8 Drawing Sheets

REFERENCE VOLTAGE GENERATING CIRCUIT, A SEMICONDUCTOR INTEGRATED CIRCUIT AND A SEMICONDUCTOR INTEGRATED CIRCUIT APPARATUS

CROSS-REFERENCE TO RELATED APPLICATION

The present application claims priority from Japanese patent applications No. 2006-168393 filed on Jun. 19, 2006, and No. 2005-258870 filed on Sep. 7, 2005, the contents of which are hereby incorporated by reference into this application.

BACKGROUND OF THE INVENTION

The present invention relates to a technique for generating a reference voltage of a semiconductor integrated circuit and, more particularly, to a band gap type reference voltage generating circuit which operates on a low power supply voltage. The invention relates to a technique effectively applied to a reference voltage generating circuit for generating a reference voltage necessary for, for example, an A/D converter or a D/A converter.

Since a reference voltage is necessary for a converting operation in an A/D converter or a D/A converter, a semiconductor integrated circuit having therein an A/D converter or a D/A converter is provided with a reference voltage generating circuit. Reference voltage generating circuits in various circuit forms using a zener diode, a differential amplifier, and the like are known. Among the circuits, a circuit called a band gap reference circuit can generate a stable reference voltage having low power supply voltage dependency and low temperature dependency. Consequently, the band gap reference circuit is often used in an analog circuit such as an A/D converter, a D/A converter, or the like and a circuit including analog and digital elements required to have high precision.

On the other hand, in recent years, the power supply voltage is being lowered for lower power consumption and higher processing speed in a semiconductor integrated circuit. Accordingly, a reference voltage generating circuit provided in the semiconductor integrated circuit, that can generate a lower reference voltage is being developed.

As an example of an invention related to a reference voltage generating circuit for generating a lower reference voltage, there is a reference voltage generating circuit disclosed in Japanese Patent Laid-open No. 2004-206633. FIG. 9 shows an example of a reference voltage generating circuit disclosed in Japanese Patent Laid-open No. 2004-206633. In the reference voltage generating circuit, output voltage (Vc) of a differential amplifier AMP0 is applied to the gate terminals of MOS (Metal Oxide Semiconductor) transistors MT1, MT2, and MT0. Consequently, if the sizes of the transistors are the same, currents I0 of the same magnitude flow.

In the reference voltage generating circuit, the drain voltage of the transistors MT1 and MT2 is applied to a pair of differential input terminals of a differential amplifier AMP0. By imaginary short action of the differential amplifier AMP0, feedback is performed so that the difference between inputs Vc1 and Vc2 becomes zero. Consequently, a voltage equal to the difference between a base-emitter voltage VBE1 of a bipolar transistor BT1 and a base-emitter voltage VBE2 of a bipolar transistor BT2 is generated in a resistor R1. The drain current I0 of the transistors MT1 and MT2 is determined so as to maintain this state.

The current I0 is copied by the transistor MT0 forming a current mirror in cooperation with the transistors MT1 and MT2 and passed to an output circuit including a resistor Ra, a diode-connected transistor BT3, and a resistor Rb connected in parallel with the resistor Ra and the transistor BT3, thereby enabling low voltage output to be obtained. Since a base-emitter voltage VBE0 of the transistor BT3 has a negative temperature characteristic such that the base-emitter voltage VBE0 decreases when the temperature rises, output voltage Vbgout corresponding to a voltage obtained by adding a voltage across terminals of the resistor Ra to VBE0 is compensated by the current I0 having a positive temperature characteristic flowing in the resistors Ra and Rb, and set to a desired voltage value having no temperature dependency.

SUMMARY OF THE INVENTION

The operation of the reference voltage generating circuit in the filed application is described that offset of the differential amplifier AMP0 is too small to ignore. In the case of attempting to obtain a high-precision reference voltage, however, an offset voltage between input terminals of the differential amplifier AMP0 cannot be ignored. When the input offset voltage (hereinbelow, simply called offset) of the differential amplifier AMP0 is $V_{os}$, the reference voltage generating circuit in the filed application operates so as to satisfy the relation of Vc2−Vc1=$V_{os}$. Consequently, the current flowing in the resistor R1 changes by the amount of $V_{os}$, and it causes variations in the output.

When thermal voltage is expressed as VT=kT/q (T: absolute temperature, k: Boltzmann constant, q: charge quantity) and Is denotes reverse-direction saturation current of a bipolar transistor, under the condition that forward current flows between the bases and emitters of the transistors BT1 and BT2, VBE1 and VBE2 are expressed as follows.

$$VBE1=VT*\mathrm{In}(I0/\mathrm{Is})$$

$$VBE2=VT*\mathrm{In}(I0/(n*\mathrm{Is}))$$

In the expressions, "*" indicates a multiplication sign and "/" indicates a division sign. When it is considered that the differential amplifier has an offset, Vc2−Vc1=$V_{os}$. Since Vc1=VBE1 and Vc2=VBE2+I0*R1, they are substituted for the expressions and organized as follows.

$$I0=VT*R1*\mathrm{In}(n)+Vos/R1 \quad (1)$$

As for the output voltage Vbgout, the equation of Vbgout/Rb+(Vbgout−VBE3)/Ra=I0 is satisfied. The equation is rearranged with respect to the output voltage Vbgout as follows.

$$Vb\mathrm{gout}=Ra*Rb/(Ra+Rb)*I0+Rb/(Ra+Rb)*VBE3$$

When the current I0 in the equation (1) is substituted, the following is obtained.

$$Vb\mathrm{gout}=Ra*Rb/(Ra+Rb)*(VT*R1*\mathrm{In}(n)+Vos/R1)+Rb/(Ra+Rb)*VBE3$$

From the above, a rage of change of Vbgot with respect to Vos is expressed as follows.

$$dVb\mathrm{gout}/dVos=Ra*Rb/((Ra+Rb)*R1) \quad (2)$$

A variation of this magnitude occurs in the output due to the offset of the differential amplifier.

An object of the present invention is to provide a band gap type reference voltage generating circuit and a semiconductor integrated circuit having the same, capable of generating a reference voltage of about 1.2V or less subjected to temperature compensation and power supply voltage compensation, and reducing the offset voltage dependency of the differential amplifier.

The above and other objects and novel features of the invention will become apparent from the description of the specification and appended drawings.

Outline of representative ones of inventions disclosed in the present application will be described as follows.

A reference voltage generating circuit according to the present invention includes a band gap part and an output part. The band gap part has: a first resistor and a first bipolar transistor connected in series between power supply voltage terminals; a second resistor, a second bipolar transistor, and a third resistor connected in series between the power supply voltage terminals; and a differential amplifier that receives voltages generated by the first and second resistors. An output of the differential amplifier is applied to the bases of the two transistors. The output part has a bipolar transistor having a base to which the output of the differential amplifier is applied, a resistor connected in series with the transistor, a current mirror circuit for transferring current flowing in the transistor, and a resistor and a diode for converting the transferred current to voltage.

With the above-described means, negative feedback is performed from output to input of the differential amplifier in the band gap part so that an output of the differential amplifier becomes equal to the base-emitter voltage VBE of the bipolar transistor. Even if offset voltage exists in the differential amplifier and output of the differential amplifier changes, the voltage generated in the first resistor mainly changes. Therefore, a change in the output of the differential amplifier with respect to the offset voltage is reduced according to product (amplification degree) of gm (transmission conductance) of the differential amplifier and a resistance value of the first resistor.

The voltage is converted to current by the bipolar transistor, resistor, and current mirror and, further, the current is converted to voltage by an output circuit having a resistor and a diode, a voltage in which a change by the offset voltage is reduced is obtained. The temperature characteristic of voltage generated at a terminal in the resistor and that in the diode, the resistor and the diode being connected in series in the output part, are opposite to each other, so that voltage changes according to temperature change cancel out each other and output voltage having low temperature dependency is obtained. Further, the current mirror has a characteristic such that current is unchanged even if the power supply voltage fluctuates. Consequently, by converging current regenerated by the current mirror to voltage by the output circuit formed by the resistor and diode, output voltage having low power supply voltage dependency is obtained.

Preferably, a resistor is connected in parallel with the resistor and the diode for current-voltage conversion in the output part. More preferably, a startup circuit is provided which has a function of receiving/passing current from/to the first or second resistor in the band gap part on start of operation of the reference voltage generating circuit and, after the output of the differential amplifier rises to a predetermined level, interrupting the receiving current or passing current. With the configuration, a situation such that the reference voltage generating circuit becomes stable in a state other than a state where a desired output voltage is output is avoided, and accurate output voltage can be obtained.

Effects obtained by the representative one of the inventions disclosed in the application of the present invention will be briefly described as follows.

According to the invention, the band gap type reference voltage generating circuit capable of generating a reference voltage of about 1.2V or less subjected to temperature compensation and power supply voltage compensation and achieving reduced offset voltage dependency of a differential amplifier can be realized.

DETAILED DESCRIPTION OF PREFERRED EMBODIMENTS

Figure 1:
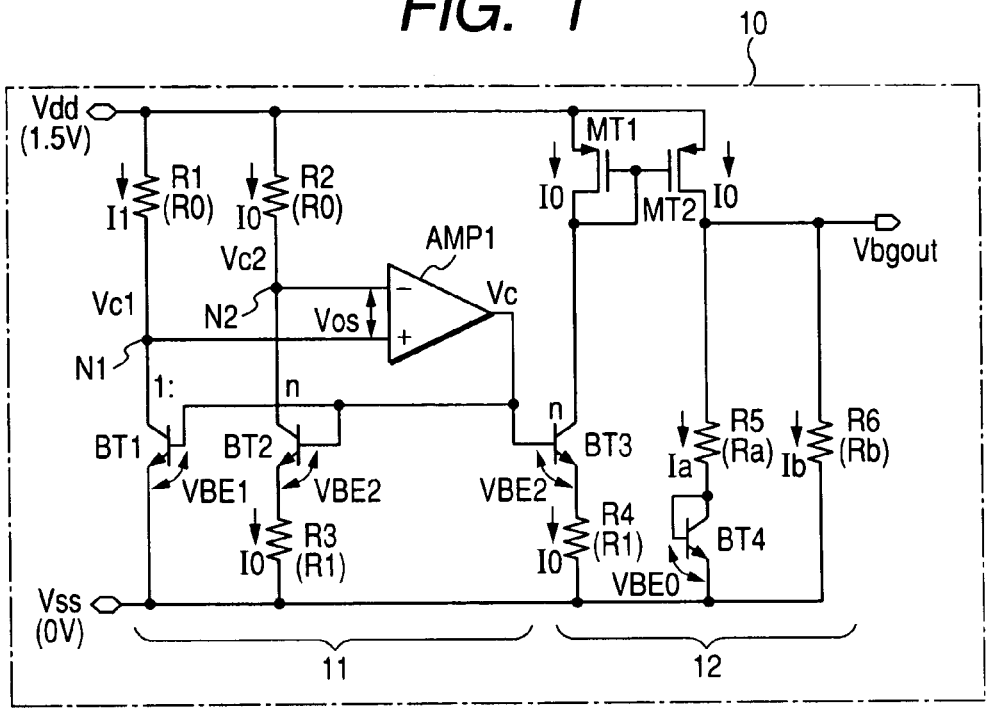
FIG. 1 is a circuit diagram showing a first embodiment of a band-gap type reference voltage generating circuit according to the invention.

FIG. 1 shows a first embodiment of a reference voltage generating circuit according to the present invention.

The reference voltage generating circuit shown in the diagram has a resistor R1 and an NPN bipolar transistor BT1 connected in series between a power supply terminal to which a power supply voltage Vdd such as 1.5V is applied and a power supply terminal to which a power supply voltage Vss such as a ground potential (0V) is applied. The reference voltage generating circuit also has a resistor R2, an NPN bipolar transistor BT2, and a resistor R3 connected in series between the power supply terminals. The resistors R1 and R2 have the same resistance value R0. The transistors BT1 and BT2 are set so that the emitter size has a ratio of 1:n. As the value of "n", for example, "10" is selected. In place of setting the emitter size to 1:n, as the transistor BT2, n pieces of transistors of the same size as that of the transistor BT1 may be connected in parallel.

Further, a differential amplifier AMP1 is provided in which a potential Vc1 at a connection node N1 between the resistor R1 and the transistor BT1 is applied to a non-inversion input terminal and a potential Vc2 at a connection node N2 between the resistor R2 and the transistor BT2 is applied to an inversion input terminal. An output of the differential amplifier AMP1 is applied to base terminals of the transistors BT1 and BT2, and currents I1 and I0 are passed to the transistors BT1 and BT2 so that the potentials Vc1 and Vc2 at the connection nodes N1 and N2 become the same (Vc1=Vc2). By the resistors R1, R2, and R3, the transistors BT1 and BT2, and the differential amplifier AMP1, a band gap part 11 for outputting voltage according to base-emitter voltage VBE1 of the bipolar transistor BT1 is formed. In the configuration, the current I0 is in direct proportion with the absolute temperature.

To pass the same current as the current I0 of the transistor BT2, an NPN bipolar transistor BT3 having the same size as that of the transistor BT2 and a resistor R4 are provided. Between the collector side of the transistor BT3 and the power supply voltage Vdd, a P-channel type MOS transistor (insulated gate field effect transistor) MT1 which forms a current mirror is provided. The resistor R4 has the same reference value R1 as that of the resistor R3. The MOS transistor MT1 in which the gate and the drain are coupled to each other acts as current-voltage converting means. By applying the converted voltage to the gate terminal of the other P-channel type MOS transistor MT2 as a component of the current mirror, current according to the size ratio (the gate width ratio) between the MOS transistors MT1 and MT2 is passed to the MOS transistor MT2.

In the embodiment, by making the MOS transistors MT1 and MT2 have the same size, the same current as that of the MOS transistor MT1 is passed to the MOS transistor MT2. A resistor R5 and a so-called diode-connected bipolar transistor BT4 in which the base and the collector are coupled to each other are connected in series with the MOS transistor MT2. A resistor R6 is provided in parallel with the resistor R5 and the bipolar transistor BT3. An output part 12 is constituted by the transistor BT3, resistor R4, current mirror (MT1 and MT2), resistor R5, and diode-connected transistor BT4.

In the output part 12, the negative temperature characteristic of the base-emitter voltage VBE0 of the transistor BT4 is canceled out by the current I0 (that is, Ia and Ib) which is direct proportional with the absolute temperature and the voltage of the resistors R5 and R6, the output voltage Vbgout having low temperature dependency is obtained. The current of the transistor BT3 is regenerated by the current mirror constructed by the MOS transistors MT1 and MT2 and passed to the series resistor R5 and the diode-connected transistor BT4. Since the current is unchanged even when the power supply voltage Vdd of the current mirror fluctuates, the output voltage Vbgout having low power supply voltage dependency is obtained.

The resistor R5 and the diode-connected transistor BT4 may be connected opposite to each other. The current mirror may be formed by using a PNP bipolar transistor in place of the MOS transistors MT1 and MT2. The differential amplifier AMP1 is constructed by a MOS transistor. A circuit having a differential amplifier stage constructed by a pair of differential transistors whose sources are commonly connected, a constant current source connected to the common source, and a passive element connected to the drain side of the differential transistor, or a circuit in which an output part of a source grounding type, a source follower type, or the like is connected to a differential amplifier stage is used.

In the reference voltage generating circuit of FIG. 1, when there is no offset voltage in the differential amplifier AMP1, current flows in the transistors BT1 and BT2 so that Vc1 becomes equal to Vc2. On the other hand, when there is an offset voltage in the differential amplifier AMP1, the output Vc changes. Mainly Vc1 changes from the state where ΔVc1/ΔVc=gm*R0 and ΔVc2/ΔVc is almost equal to R0/R1, and a change in Vc relative to offset voltage=|ΔVc1−ΔVc2| which is almost equal to |ΔVc1| is reduced to 1/gm*R0. That is, by connecting an amplifier constructed by the bipolar transistor BT1 and the resistor R1 to the output and feeding back the voltage to the input to control the offset voltage, it is considered that a change in the output Vc decreases.

In the embodiment, to copy the current flowing in the bipolar transistor BT2 by the current mirror and output the resultant, the output voltage Vc of the differential amplifier AMP1 is converted to current by the bipolar transistor BT3 and the resistor R3 having the resistance value R1. To enable the output to be captured at the ground (Vss) reference, the collector current is of the transistor BT3 is returned by the current mirror formed by the MOS transistors M1 and M0. By passing the returned current to an output circuit constructed by the resistors Ra and Rb and the diode-connected bipolar transistor BT4, voltage obtained by reducing a change by the offset voltage is obtained. In the above equation, gm denotes transmission conductance of the differential amplifier AMP1.

In the following, the operation of the reference voltage generating circuit of FIG. 1 in the case where there is offset voltage in the differential amplifier AMP1 will be described.

In the reference voltage generating circuit of FIG. 1, when the offset voltage of the differential amplifier AMP1 is set as Vos and the reverse-direction saturation current of the bipolar transistor is set as Is, Vos=Vc2−Vc1. From the relations of Vc2=Vdd−I0R0 and Vc1=Vdd−I1R0, the relation of I1=I0+Vos/R0 is satisfied between the currents I1 and I0 flowing in the resistors R1 and R2. Consequently, under the condition that the forward current flows between the base and emitter in each of the transistors BT1 and BT2, the base-emitter voltages VBE1 and VBE2 in the transistors BT1 and BT2 are expressed as follows.

$$VBE1=VT*\ln((I0+Vos/R0)/Is)$$

$$VBE2=VT*\ln(I0/(n*Is))$$

The output voltage Vc of the differential amplifier AMP1 is expressed as follows.

$$Vc = VBE1 = VBE2 + I0 * R1$$

When VBE1 and VBE2 are eliminated from the above expressions, the following is obtained.

$$Vc = VT * In((I0 + Vos / R0) / Is) = VT * In(I0 / (n * Is)) + I0 * R1$$

The above is organized as follows.

$$VT*\mathrm{In}(1+Vos/(I0*R0))=I0*R1-VT*\mathrm{In}(n)$$

When it is assumed that Vos is sufficiently small and the relation of Vos/(I0*R0)<<1 is satisfied, since In(1+Vos/(I0*R0)) is almost equal to Vos/(I0*R0), the following is satisfied.

$$VT*Vos/(I0*R0)=10*R1-VT*\mathrm{In}(n)$$

The expression is rewritten as follows.

$$I0*I0-I0*VT/R1*\mathrm{In}(n)-VT*Vos/(R0*R1)=0$$

To see a change in I0 relative to Vos, differentiation with Vos is carried out as follows.

$$210*dI0/dVos-VT/R1*\mathrm{In}(n)*dI0/dVos-VT/(R0*R1)=0$$

This is organized as follows.

$$dI0/dVos=VT/(R0*(2I0*R1-VT*\mathrm{In}(n)))$$

The output voltage Vbgout is generated by passing the current obtained by copying I0 to a parallel circuit between the resistor R5, the transistor BT4, and the resistor R6. Consequently, when the resistance value of the resistor R5 is set as Ra, the base-emitter voltage of the transistor BT4 is set as VBE0, and the resistance value of the resistor R6 is Rb, from the relation of $$Ra*(I0-Vb\mathrm{gout}/Rb)=Vb\mathrm{gout}-VBE0,$$

the following expression is obtained.

$$Vb\mathrm{gout}=Ra*Rb/(Ra+Rb)*I0+Rb/(Ra+Rb)*VBE0 \quad (3)$$

The reference voltage generating circuit of the embodiment can generate the output voltage Vbgout of about 1.2V or less under the power supply voltage Vdd such as 1.5V by properly setting the resistance values Ra and Rb of the resistors R5 and R6 and the current I0. For example, in the case where Ra=26 kΩ, Rb=65 kΩ, and I0=20 μA, when it is assumed that VBE0=0.7V, Vbgout becomes almost equal to 0.87V.

From the equation (3), a change rate dVbgout/dVos with respect to the offset Vos of the output voltage Vbgout is expressed as follows.

$$\begin{aligned}\frac{dVbgout}{dVos} &= Ra * Rb(Ra + Rb) * \frac{dI0}{dVos}\\ &= Ra * Rb / (Ra + Rb) * VT(R0 * (2I0 * R1 - VT * In(n)))\\ &= Ra * Rb / (Ra + Rb) * 1 / R1 *\\ &\quad 1(2I0 * R / VT - R0 / R1 * In(n))\\ &= Ra * Rb / ((Ra + Rb) * R1) *\\ &\quad 1 / (2I0 * R0 / VT - R0 / R1 * In(n))\end{aligned}$$

where Ra*Rb/((Ra+Rb)*R1) is the same value as that of the circuit of the invention in the earlier application (refer to Expression (2)). Therefore, when 2I0*R0/VT−R0/R1*In(n)>1, the change rate dVbgout/dVos is improved.

As an example, the case where 10=20 μA, R0=25 kΩ, R1=3 kΩ, n=10, and T=25° C. is considered. Since VT=kT/q is almost 26 mV, the following is expressed.

$$\begin{aligned}2I0 * R0 / VT - R0 / R1 * In(n) &= 2 * 20 * 10^{-6} * 25 * 10^{3} / 26 * 10^{-3} -\\ &\quad 25 * 10^{3} / 3 * 10^{3} * In10\\ &= 38.5 - 19.2\\ &= 19.3 > 1\end{aligned}$$

It is understood that the object can be easily achieved.

Further, the change rate dVbgout/dVos in the case where Ra=26 kΩ and Rb=65 kΩ is 0.321. On the other hand, in the reference voltage generating circuit of the earlier invention of FIG. 9, the change rate dVbgout/dVos in the case where the conditions almost same as t=20 μA, R1=3 kΩ, n=10, T=25° C., Ra=26 kΩ, and Rb=52 kΩ is 5.777. Consequently, it is understood that a fluctuation in the output voltage with respect to variations in the offset of the differential amplifier can be largely reduced as compared with that in the circuit of the invention in the earlier application.

In the embodiment, as the transistors BT1, BT2, and BT3, common bipolar transistors having a vertical structure can be used in the bipolar integrated circuit. However, since MOS transistors and bipolar transistors are mixedly mounted, the process is complicated. In the embodiment, therefore, as the transistors BT1, BT2, and BT3, transistors which can be formed by the CMOS process are used. Consequently, the process can be simplified and increase in cost can be avoided. The resistors R1 to R6 may be a formed film such as a polysilicon layer or a diffusion layer (well).

Figure 3:
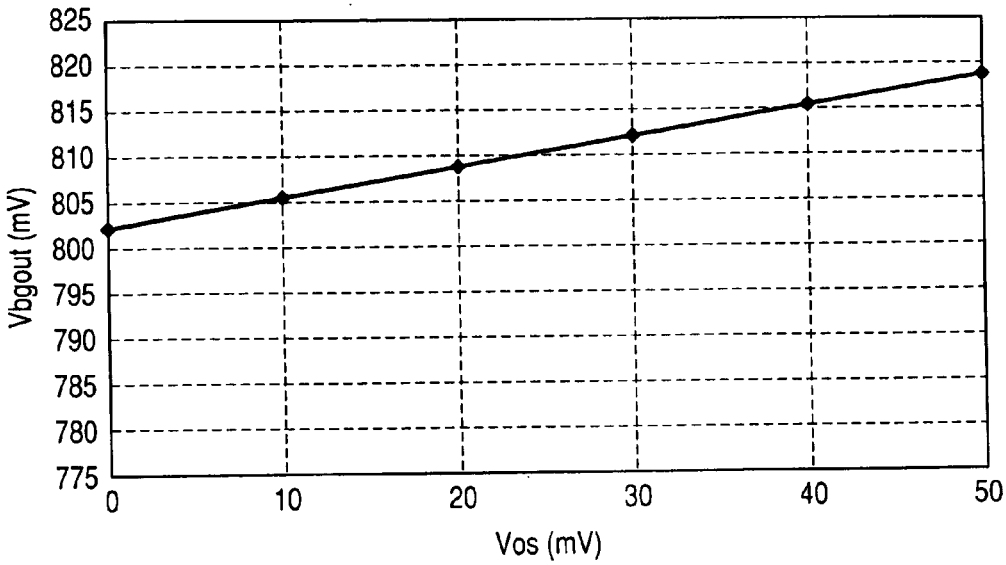
FIG. 3 is a characteristic diagram showing offset voltage dependency of output voltage Vbgout of the band-gap type reference voltage generating circuit of the first embodiment.
Figure 4:
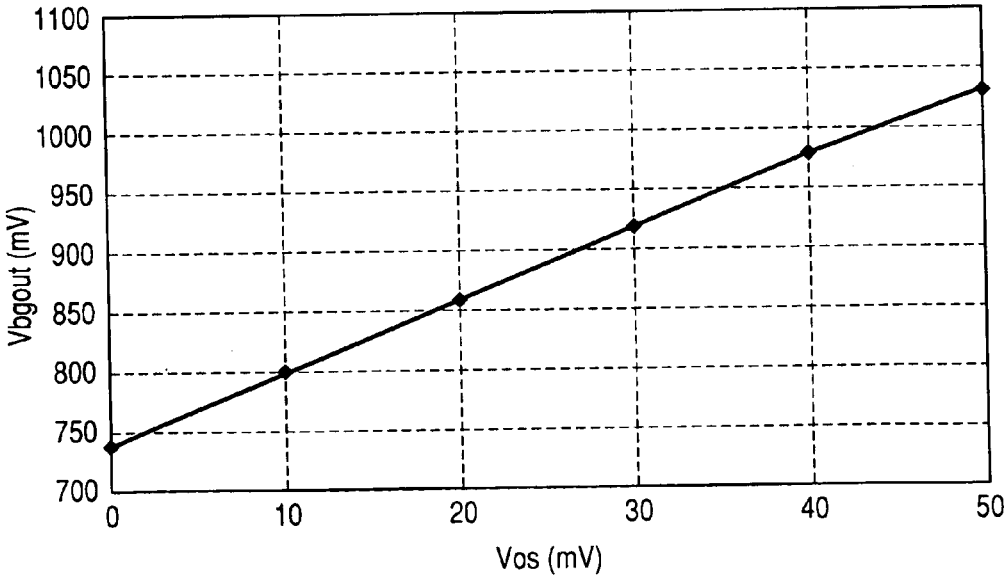
FIG. 4 is a characteristic diagram showing offset voltage dependency of output voltage of a reference voltage generating circuit of an invention in an earlier application.

FIG. 3 shows the offset voltage dependency of the output voltage Vbgout in the reference voltage generating circuit of the embodiment of FIG. 1. For comparison, FIG. 4 shows the offset voltage dependency of the output voltage Vbgout in the reference voltage generating circuit of the invention in the earlier application of FIG. 9. It is understood by comparison between FIGS. 3 and 4, the gradient in FIG. 3 is gentler, so that fluctuations in the output voltage with respect to variations in the offset are small. Since the scale of the axis of ordinates in the graph of FIG. 3 is enlarged more than that in the graph of FIG. 4, it should be noted that the fluctuations in the output voltage are smaller than they look.

Figure 2:
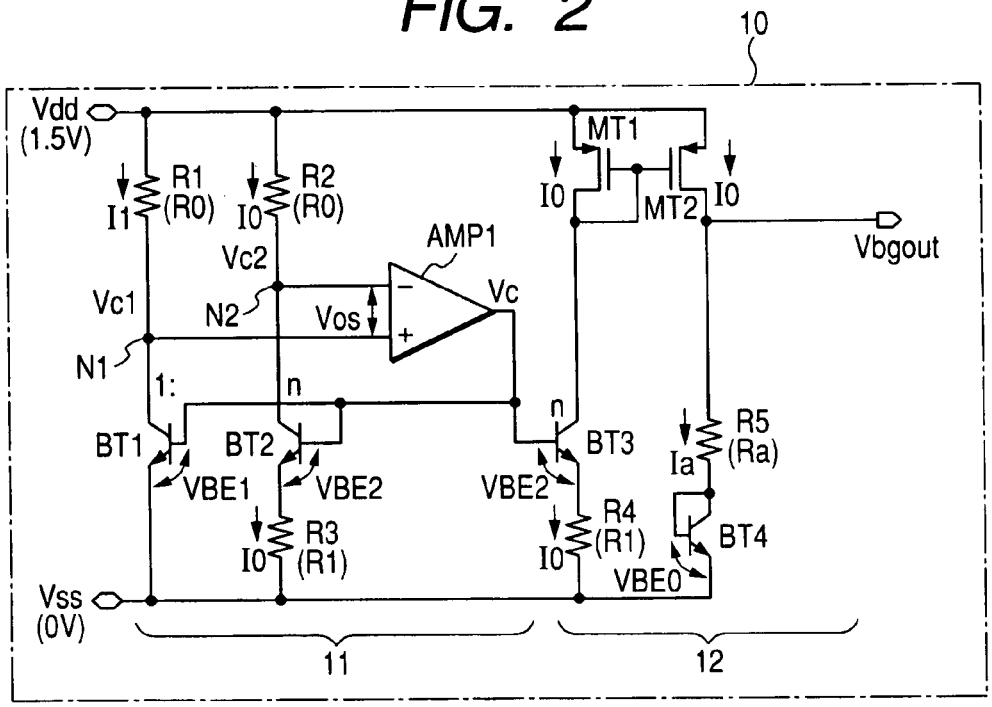
FIG. 2 is a circuit diagram showing a modification of the band-gap type reference voltage generating circuit of a first embodiment.

FIG. 2 shows a modification of the reference voltage generating circuit of the embodiment of FIG. 1. In the modification, the resistor R6 in the output part in the circuit of FIG. 1 is eliminated, so that the output voltage Vbgout is slightly higher than that in the circuit of FIG. 1. The other configuration is the same as the circuit of FIG. 1 and, similarly, fluctuations in the output voltage Vbgout with respect to variations in the offset in the differential amplifier AMP1 in the band gap part can be reduced. When Rb=∞ in the equation (3), the output voltage Vbgout of the circuit of FIG. 2 is obtained. In the case of settings that Ra=26 kΩ and I0=20 μA in a manner similar to the description in the circuit of FIG. 1, when VBE0 is assumed to be 0.7V, if Rb=∞, Ra<<Rb. Ra+Rb can be approximated to Rb, so that the equation (3) can be modified as follows.

$$Vb\mathrm{gout}=Ra*I0+VBE0$$

As a result, Vbgout becomes almost equal to 1.22V.

Figure 5:
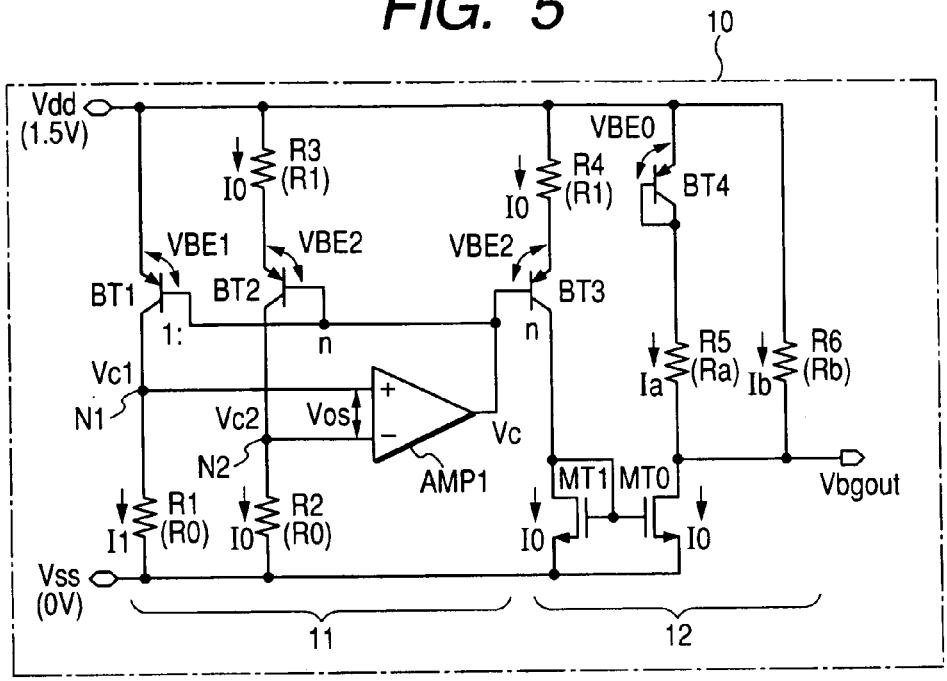
FIG. 5 is a circuit diagram showing a second embodiment of the band-gap type reference voltage generating circuit according to the present invention.

FIG. 5 shows a second embodiment of the reference voltage generating circuit according to the invention. In the second embodiment, PNP transistors are used in place of NPN transistors as the transistors BT1, BT2, and BT3 in the first embodiment. As the MOS transistors MT1 and MT2, N-channel MOSFETs are used in place of the P-channel MOSFETs.

In accordance with the change, to reverse the potential relations in the embodiment of FIG. 1, the transistors BT1, BT2, and BT3 and the resistors R3 and R4 are provided on the side of the power supply voltage Vdd, and the resistors R1 and R2 and the transistors MT1 and MT2 are provided on the side of the power supply voltage Vss. Further, as the differential amplifier AMP1, a circuit using a P-channel MOS transistor as a differential input transistor is used. Since the principle of operation of the reference voltage generating circuit of the second embodiment is the same as that of the reference voltage generating circuit of the embodiment of FIG. 1, the detailed description of the operation will not be repeated.

Figure 6:
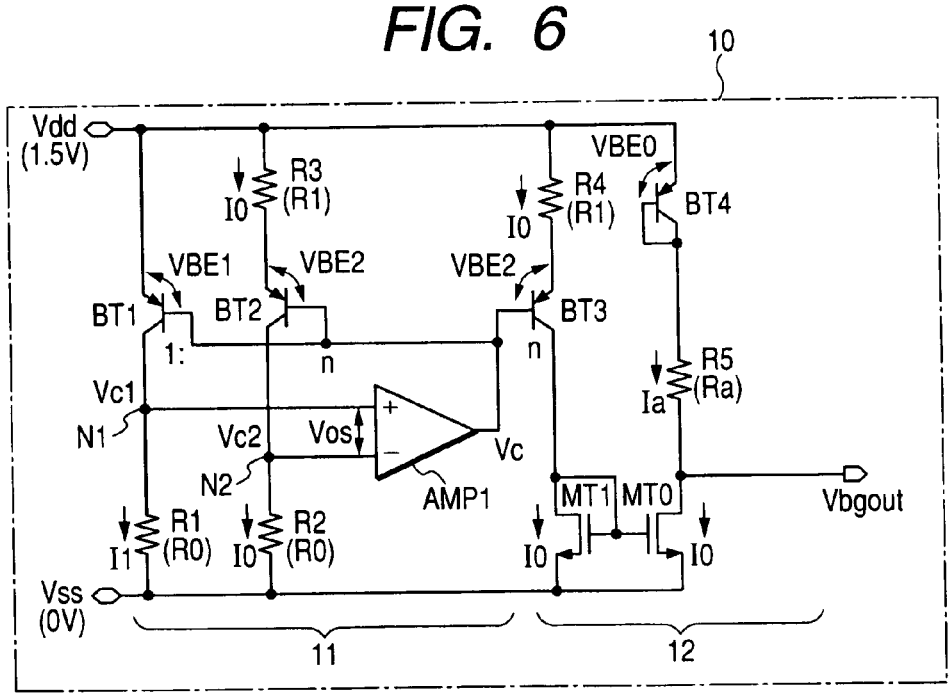
FIG. 6 is a circuit diagram showing a modification of the band-gap type reference voltage generating circuit according to the second embodiment.

FIG. 6 shows a modification of the reference voltage generating circuit of the second embodiment of FIG. 5. In the modification, the resistor R6 in the output part in the circuit of FIG. 5 is omitted, and the output voltage Vbgout is slightly lower than that in the circuit of FIG. 5. The other configuration is the same as that of the circuit of FIG. 5. Similarly, fluctuations in the output voltage with respect to variations in the offset of the differential amplifier can be reduced.

Figure 7:
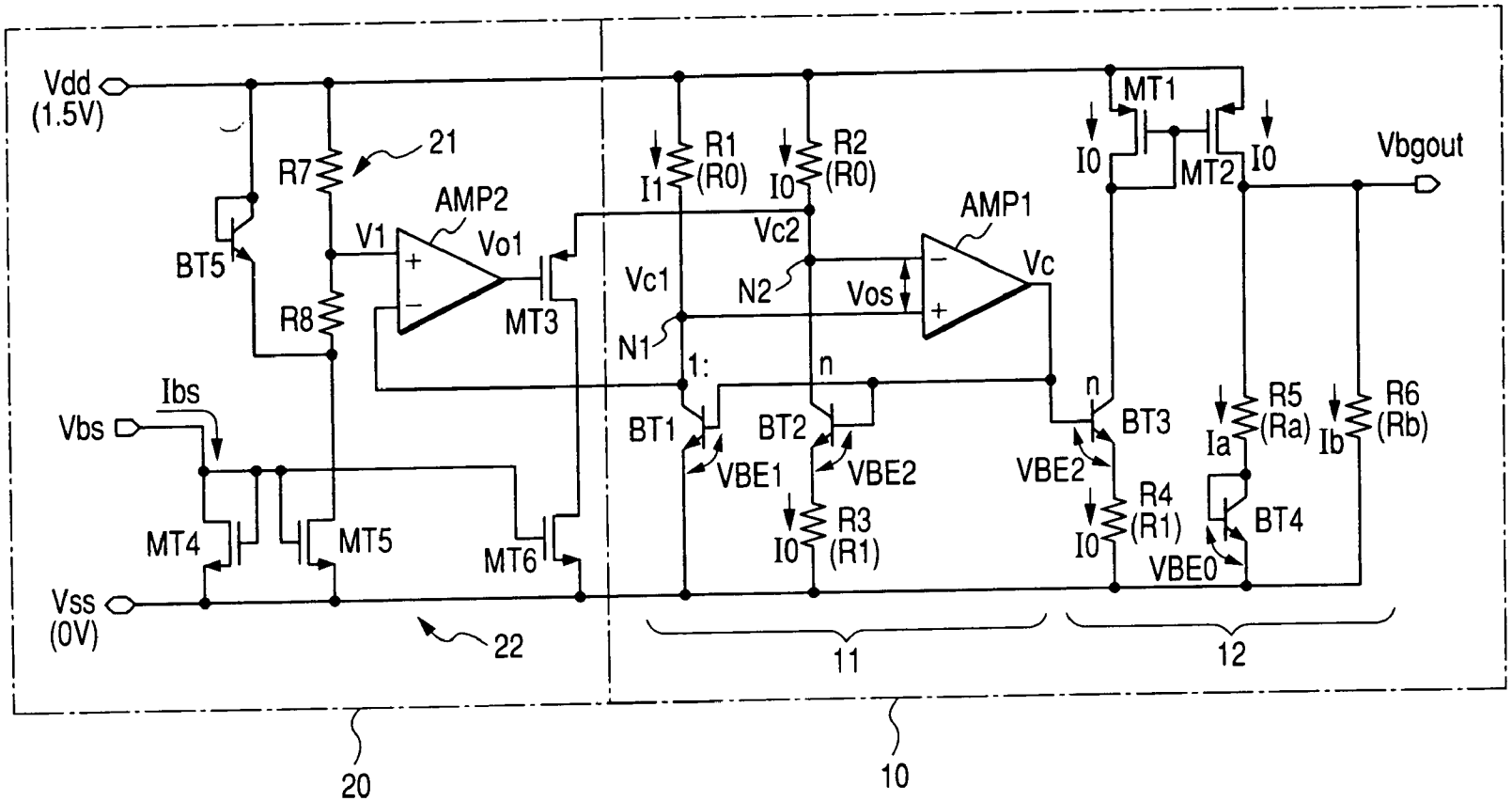
FIG. 7 is a circuit diagram showing a third embodiment of the band-gap type reference voltage generating circuit according to the present invention.

FIG. 7 shows a third embodiment of the reference voltage generating circuit according to the invention. In the third embodiment, a startup circuit 20 is added to a reference voltage generating circuit 10 having a configuration similar to that of the first embodiment to avoid a situation such that when the reference voltage generating circuit 10 starts operating, the operation becomes stable at an undesired operation point, and a desired output voltage cannot be obtained.

The startup circuit 20 has a MOS transistor MT3 whose source terminal is connected to the connection node N2 between the resistor R2 and the transistor BT2 in the reference voltage generating circuit 10 and for receiving the current from the resistor R2 not through the transistor BT2, and a differential amplifier AMP2 functioning as a comparator for on/off controlling the transistor MT3. The startup circuit 20 also has a resistance dividing circuit 21 formed by resistors R7 and R8 for applying a reference voltage Vref to the differential amplifier AMP2, a current mirror circuit 22 for receiving current from the MOS transistor MT3 and the resistance dividing circuit 21 on the basis of control current Ibs, and a diode-connected transistor BT5 for protection which is provided in parallel with the resistors R7 and R8.

The reference voltage Vref generated by the resistance dividing circuit 21 is applied to the non-inversion input terminal of the differential amplifier AMP2, the potential Vc1 at the node N1 of the reference voltage generating circuit 10 is applied to the inversion input terminal of the differential amplifier AMP2. The current mirror circuit 22 is formed by a diode-connected MOS transistor MT4 whose gate and drain are coupled to each other and converting the control current Ibs to a voltage, and MOS transistors MT5 and MT6 in which the same voltage as the gate voltage of the MOS transistor MT4 is applied to the gates. In the third embodiment, the MOS transistors MT4 to MT6 are of the N-channel type.

Before the reference voltage generating circuit 10 is started, no current flows in the resistor R1, so that the potential Vc1 at the node N1 is at the Vdd level. Consequently, the output Vol of the differential amplifier AMP2 is at the low level. In the case of starting the reference voltage generating circuit 10, first, the control current Ibs is passed to the startup circuit 20. Current is passed to the resistor R2 via the MOS transistor MT3 which is turned on by the output Vol of the differential amplifier AMP2, and the potential Vc2 of the node N2 drops. Accordingly, the output Vc of the differential amplifier AMP1 changes to the high level, the transistors BT1 to BT3 are turned on, and current flows in the resistors R1 and R2.

In such a state, the potential Vc1 at the node N1 becomes lower than the reference voltage Vref generated by the resistance voltage dividing circuit 21, the output Vol of the differential amplifier AMP2 is inserted, and the MOS transistor MT3 for bypass is turned off. It makes the reference voltage generating circuit 10 enter a state equivalent to the state where there is no startup circuit 20, the currents I0 and I1 of a preliminarily assumed desired magnitude flow in the resistors R1 and R2, and the desired voltage Vbgout is output. Once the reference voltage generating circuit 10 shifts to such a state, even if the control current Ibs is interrupted, the reference voltage generating circuit 10 keeps on normally operating. Therefore, the control current Ibs can be used as a current pulse.

In the startup circuit 20 of the third embodiment, the MOS transistor MT3 for receiving current from the reference voltage generating circuit 10 is connected to the connection node N2 between the resistor R2 and the transistor BT2. Alternatively, the MOS transistor MT3 may be connected to the connection node N1 between the resistor R1 and the transistor BT1. In this case, the potential Vc2 at the connection node N2 between the resistor R2 and the transistor BT2 is applied to the inversion input terminal of the differential amplifier AMP2.

Figure 8:
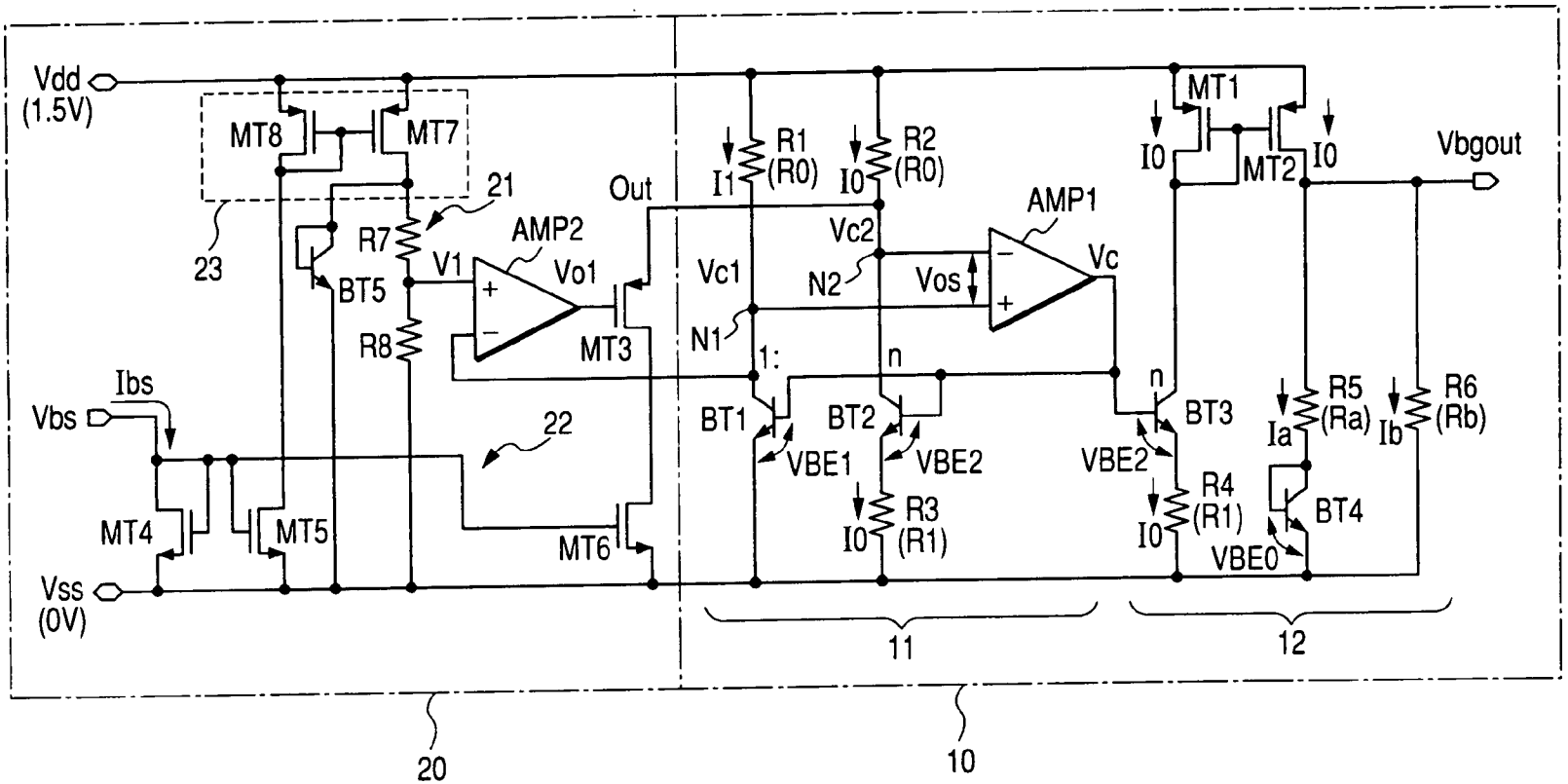
FIG. 8 is a circuit diagram showing a modification of the band-gap type reference voltage generating circuit of the third embodiment.

FIG. 8 shows a modification of the reference voltage generating circuit with the startup circuit of FIG. 7. In the modification, the MOS transistor MT7 for passing current to the divided resistors R7 and RB for generating the reference potential Vref of the differential amplifier AMP2 in the embodiment of FIG. 7 is provided on the side of the power supply voltage Vdd, not the side of the ground potential Vss. To send back the current flowing in the MOS transistor MT4 to which the control current Ibs flows and the MOS transistor MT5 forming a current mirror, a second current mirror circuit 23 having the MOS transistors MT8 and MT7 is provided. The current transferred to the MOS transistor MT7 by the current mirror circuit 23 is passed to the divided resistors R7 and R8. Since the function and operation of the startup circuit in the modification are almost similar to those of the startup circuit of FIG. 7, the detailed description will not be repeated.

In the modification as well, the MOS transistor MT3 for drawing current from the reference voltage generating circuit 10 can be connected to the connection node N1 between the resistor R1 and the transistor BT1. In FIGS. 7 and 8, the reference voltage generating circuit 10 having a configuration similar to that shown in FIG. 1 is shown. However, the invention can be also applied to the case of using the reference voltage generating circuit 10 shown in FIG. 2, 5, or 6.

When the invention is applied to the case using the reference voltage generating circuit 10 shown in FIGS. 5 and 6, the MOS transistors MT4 to MT6 forming the current mirror are provided on the power supply voltage Vdd side, not the ground potential Vss side. The MOS transistor MT3 which is connected to the connection node N2 between the resistor R2 and the transistor BT2 and on/off controlled by the differential amplifier AMP2 operates so as to pass current to the resistor R2.

Figure 9:
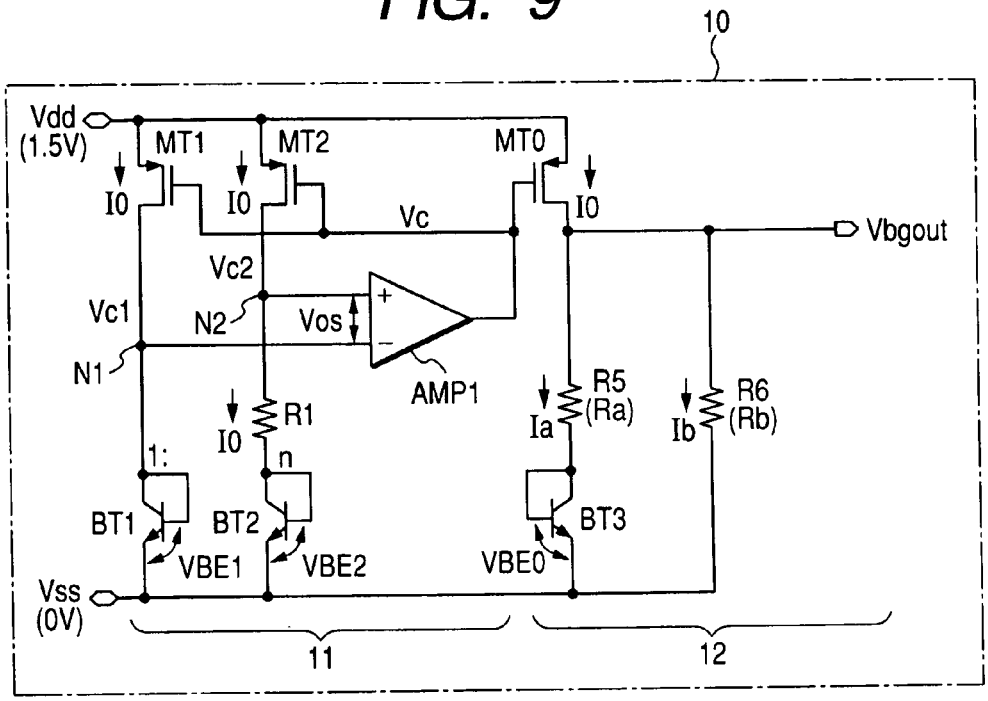
FIG. 9 is a circuit diagram showing a configuration example of a band-gap type reference voltage generating circuit according to an invention in an earlier application.

In the reference voltage generating circuit using a MOS transistor and a bipolar transistor, in the case of using a bipolar transistor as a diode as shown in FIG. 9, the amplification factor of the device may be low. Consequently, a so-called horizontal-type bipolar transistor in which operation current flows mainly in the direction of a plane of a substrate, which can be formed by the CMOS Process, can be used.

On the other hand, in the case of using the bipolar transistors BT1 to BT3 as amplification elements as in the reference voltage generating circuit of the embodiment of the present invention, the amplification factor of the device is preferably high to a certain extent. Consequently, it is desirable to use a so-called vertical bipolar transistor in which operation current flows mainly in the perpendicular direction of the substrate. The general vertical bipolar transistor is formed by a process different from that of a CMOS integrated circuit. The reference voltage generating circuit in the embodiment of the present invention uses a vertical bipolar transistor which can be formed by the CMOS process. In the following, the structure of such a vertical bipolar transistor will be described.

Figure 10A:
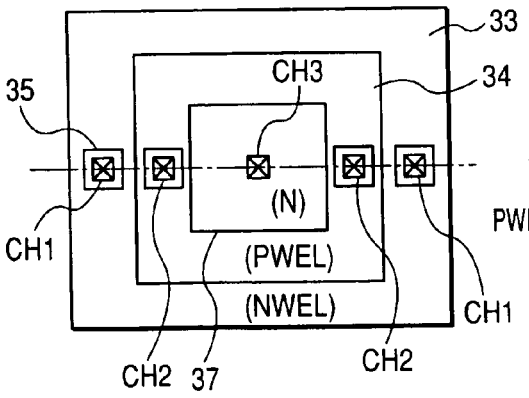
FIGS. 10A and 10B are a layout diagram and a cross section, respectively, showing an example of an NPN bipolar transistor as a component of the reference voltage generating circuit of the embodiment of FIG. 1.
Figure 10B:
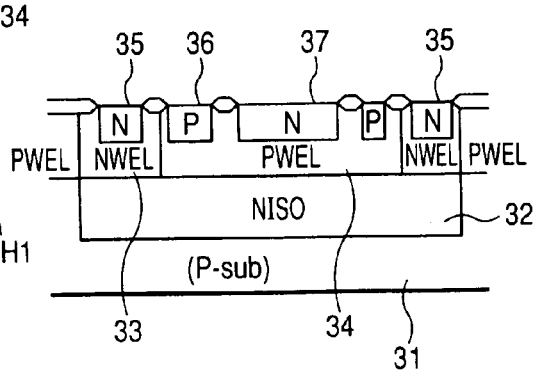
Figure 11A:
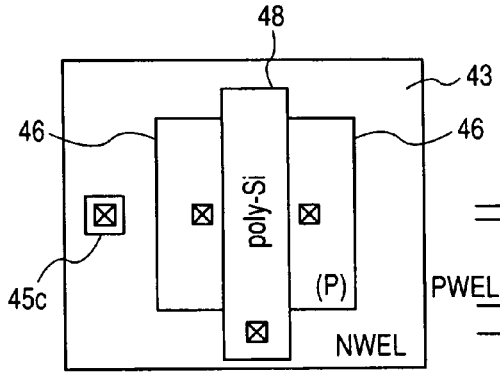
FIGS. 11A and 11B are a layout diagram and a cross section, respectively, showing an example of a P-channel MOS transistor as a component of the reference voltage generating circuit of the embodiment of FIG. 1.
Figure 11B:
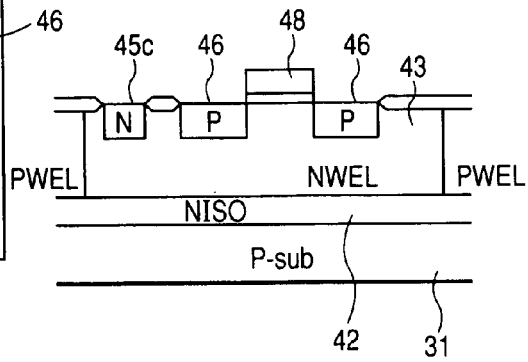
Figure 12A:
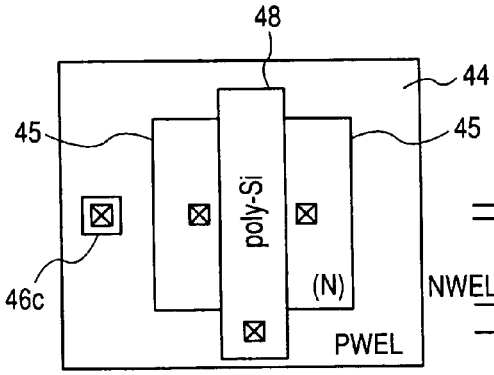
FIGS. 12A and 12B are a layout diagram and a cross section, respectively, showing an example of an N-channel MOS transistor as a component of the reference voltage generating circuit of the embodiment of FIG. 1.
Figure 12B:
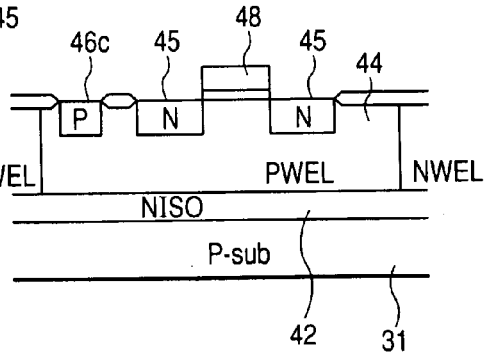

FIGS. 10A and 10B show an example of an NPN bipolar transistor used as the transistors BT1 to BT3 forming the reference voltage generating circuit of the embodiment of FIG. 1. FIGS. 11A and 11B show an example of a P-channel MOS transistor used as the transistors MT1, MT2, and the like in FIG. 1. FIGS. 12A and 12B show an example of an N-channel MOS transistor as a component of the differential amplifier AMP1 in FIG. 1.

As shown in FIG. 10B, the NPN bipolar transistor has an N-type buried region 32 formed in a semiconductor substrate 31 made of single crystal silicon or the like, an N-type region 33 and a P-type region 34 formed on the buried region 32, an N-type region 35 formed in the surface of the N-type region 33, and a P-type region 36 and an N-type region 37 formed in the surface of the P-type region 34.

In the embodiment, the semiconductor substrate 31 is of the P-type. The buried region 32 functions as a collector region, and the N-type region 33 is in contact with the buried region 32 and functions as a collector pull-up region. The P-type region 34 functions as a base region, and the N-type region 37 functions as an emitter region. Further, the N-type region 35 functions as a contact layer of the collector pull-up region (33), and the P-type region 36 functions as a contact layer of the base region (34).

The N-type region 33 as a collector pull-up region is formed simultaneously with an N-type well region 43 in which a P-channel MOS transistor shown in FIG. 11B is formed by the same process. The P-type region 34 as a base region is formed simultaneously with a P-type well region 44 in which an N-channel MOS transistor shown in FIG. 12B is formed by the same process.

The P-type region 36 as a base contact layer is formed simultaneously with a P-type diffusion region 46 as a source/drain region of the P-channel MOS transistor shown in FIG. 11B by the same process. The N-type region 35 as a collector contact layer and the N-type region 37 as an emitter region are formed simultaneously with an N-type diffusion region 45 as a source/drain region in the N-channel MOS transistor shown in FIG. 12B by the same process.

A process of forming the N-type buried region 32 is a process which is not included in the conventional general CMOS process. Concretely, an N-type impurity is introduced onto the surface of the P-type semiconductor substrate 31. After that, a semiconductor layer serving as the N-type well region 43 and the P-type well region 44 is formed by epitaxial growth. An N-type impurity is introduced to a part as the N-type well region 43 or a P-type impurity is introduced to a part as the P-type well region 44. After that, the regions 35, 36, and 37 of the transistors are formed.

As shown in FIG. 10A, the N-type region 33 as a collector pull-up region is formed so as to surround the P-type region 34 as a base region, and the N-type region 37 as an emitter region is formed in the center of the P-type region 34 as a base region. In FIG. 10A, CH1, CH2, and CH3 denote contact holes in the collector electrode, base electrode, and emitter electrode, respectively.

In FIGS. 11A and 11B, an N-type region 45*c* is a region which becomes a contact layer to be in contact with an electrode to which the power supply voltage Vdd for reverse biasing the PN junction is applied to the N-type well region 43 as a back gate of the P-channel MOS transistor. In FIGS. 12A and 12B, a P-type region 46*c* is a region which becomes a contact layer to be in contact with an electrode to which the ground potential Vss for reverse biasing the PN junction is applied to the P-type well region 44 as a back gate of the N-channel MOS transistor.

As shown in FIGS. 11A and 11B and FIGS. 12A and 12B, in the embodiment, an N-type isolation region 42 is formed below the N-type well region 43 and the P-type well region 44 in which a P-channel MOS transistor and an N-channel MOS transistor are formed, respectively. However, the N-type isolation region 42 may not be provided. By providing the N-type isolation region 42 in part of the MOS transistor and applying a predetermined potential, leak current flowing in the substrate can be reduced. The N-type isolation region 42 in the part of the MOS transistor is formed in the same process as that of the N-type buried region 32 as the collector of the bipolar transistor.

Figure 13A:
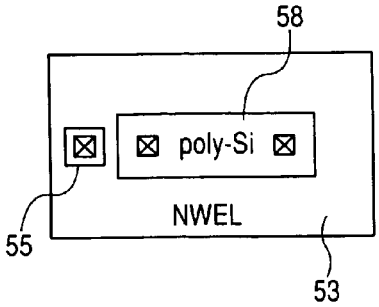
FIGS. 13A and 13B are a layout diagram and a cross section, respectively, showing an example of a resistive element as a component of the reference voltage generating circuit in the embodiment of FIG. 1.
Figure 13B:
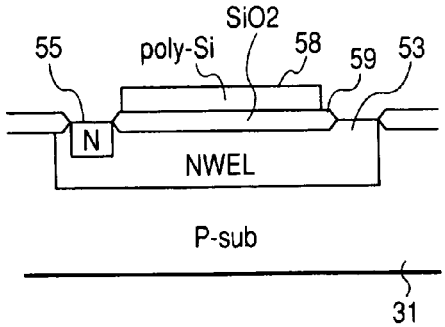

FIGS. 13A and 13B show an example of the resistors R1 to R6 in FIG. 1 forming the reference voltage generating circuit. As shown in FIGS. 13A and 13B, the resistors R1 to R6 are constructed by forming an insulting film 59 such as a silicon oxide film (SiO2) by thermal oxidation or the like on the surface of an N-type well region 53 formed on the semiconductor substrate 31 and forming a polysilicon layer 58 on the insulating film 59. The polysilicon layer 58 can be formed by the same process as that of the polysilicon layer 48 as the gate electrode of the P-channel MOS transistor shown in FIG. 11B and the N-channel MOS transistor shown in FIG. 12B.

To have desired sheet resistance, the impurity concentration of the polysilicon layer 58 may be different from that of the polysilicon layer 48 as the gate electrode. For example, in the polysilicon layer 48 as the gate electrode of the MOS transistor, impurity is introduced at the time of ion implantation for forming a source/drain region, thereby lowering resistance. By masking the polysilicon layer 58 as a resistor formed on the insulating film 59 so that impurities are not introduced into the polysilicon layer 58 at the time of ion implantation, the impurity concentrations can be made different from each other.

An N-type region 55 formed in part of the N-type well region 53 is a region serving as a contact layer to be in contact with an electrode to which the power supply voltage Vdd for reverse biasing the PN junction is applied to the N-type well region 53. By fixing the potential of the N-type well region 53, the N-type region 55 has the function of preventing the capacitance value of parasitic capacitance between the polysilicon layer 58 as a resistor and the substrate from fluctuating due to a voltage applied to the resistor.

Figure 14A:
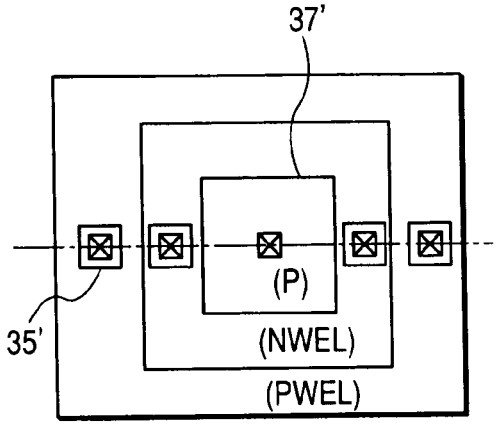
FIGS. 14A and 14B are a layout diagram and a cross section, respectively, showing an example of a PNP bipolar transistor as a component of a reference voltage generating circuit in the embodiment of FIG. 5.
Figure 14B:
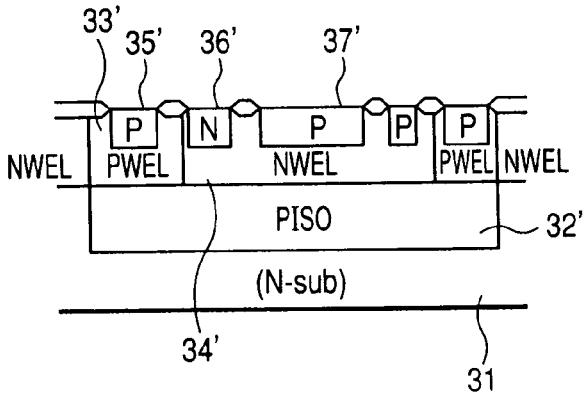

FIGS. 14A and 14B show an example of a PNP bipolar transistor used as the transistors BT1 to BT3 and the like forming the reference voltage generating circuit of FIG. 5.

The PNP bipolar transistor has, as shown in FIG. 14B, a p-type buried region 32' formed in the semiconductor substrate 31 made of single crystal silicon or the like, a P-type region 33' and an N-type region 34' formed on the buried region 32', a P-type region 35' formed in the surface of the P-type region 33', and an N-type region 36' and a P-type region 37' formed in the surface of the N-type region 34'.

In the embodiment, the semiconductor substrate 31 is of the N-type. The buried region 32' functions as a collector region, and the P-type region 33' is connected to the buried region 32' and functions as a collector pull-up region. The N-type region 34' functions as a base region, and the P-type region 37' functions as an emitter region. Further, the P-type region 35' functions as a contact layer of the collector pull-up region (33'), and the N-type region 36' functions as a contact layer of the base region (34').

The P-type region 33' as a collector pull-up region is formed simultaneously with and by the same process as the P-type well region 44 in which an N-channel MOS transistor shown in FIG. 12B is formed. The N-type region 34' as a base region is formed simultaneously with and by the same process as the N-type well region 43 in which a P-channel MOS transistor shown in FIG. 11B is formed.

The N-type region 36' as a base contact layer is formed simultaneously with and by the same process as the N-type diffusion region 45 as a source/drain region of the N-channel MOS transistor shown in FIG. 12B. The P-type region 35' as a collector contact layer and the P-type region 37' as an emitter region are formed simultaneously with and by the same process as the P-type diffusion region 46 as a source/drain region in the P-channel MOS transistor shown in FIG. 11B.

Although the present invention achieved by the inventors herein has been concretely described on the basis of the embodiments, obviously, the invention is not limited to the embodiments but can be variously modified without departing from the gist of the invention. For example, in place of a diode-connected bipolar transistor forming an output part of the reference voltage generating circuit, a PN junction diode may be used. In place of the MOS transistors MT1 to MT6, bipolar transistors may be used.

The present invention can be widely utilized for a semiconductor integrated circuit having the reference voltage generating circuit and electronic circuits to which the semiconductor integrated circuit is applied.

The reference voltage generating circuit according to the invention is effectively used for a circuit for generating a reference voltage necessary for an A/D converter or D/A converter in an analog integrated circuit having therein the A/D converter or D/A converter. It can be also used for a circuit for generating a comparison voltage used in a comparator.

What is claimed is:

1. A reference voltage generating circuit having a band gap part and an output part, wherein the band gap part has: a first resistor and a first bipolar transistor connected in series between a first power supply voltage terminal and a second power supply voltage terminal; a second resistor, a second bipolar transistor, and a third resistor connected in series between the first power supply voltage terminal and the second power supply voltage terminal; and a differential amplifier that receives voltages generated by the first and second resistors, wherein one end of the first resistor is connected to the first power supply voltage terminal, the first bipolar transistor is connected to the second power supply voltage terminal, one end of the second resistor is connected to the first power supply voltage terminal, one end of the third resistor is connected to the second power supply voltage terminal, the second bipolar transistor is connected between the second and third resistors, wherein potential at a connection point between the first resistor and the first bipolar transistor is applied to a first input terminal of the differential amplifier circuit, potential at a connection point between the second resistor and the second bipolar transistor is applied to a second input terminal of the differential amplifier circuit, an output of the differential amplifier is applied to the bases of the first and second bipolar transistors, and wherein the output part has a third bipolar transistor having a base to which the output of the differential amplifier is applied, a fourth resistor connected in series with the third bipolar transistor, a current mirror circuit for transferring current flowing in the third bipolar transistor, and a fifth resistor and a junction type passive element connected in series for converting the transferred current to voltage.

2. The reference voltage generating circuit according to claim 1, wherein the first and second resistors have the same resistance value, the third and fourth resistors have the same resistance value, and the second and third bipolar transistors include emitters of the same size.

3. The reference voltage generating circuit according to claim 2, wherein a sixth resistor is connected in parallel with the fifth resistor and the junction type passive element that are connected in series.

4. The reference voltage generating circuit according to claims 1, wherein the current mirror circuit has a diode-connected first MOS transistor connected in series with the third bipolar transistor and a second MOS transistor having a gate terminal to which the same voltage as the gate voltage of the first MOS transistor is applied, and wherein the differential amplifier is constructed by a MOS transistor.

5. The reference voltage generating circuit according to claim 4, wherein the first, second, and third bipolar transistors are NPN-type bipolar transistors, and wherein the first and second MOS transistors are P-channel type MOS transistors.

6. The reference voltage generating circuit according to claim 4, wherein the first, second, and third bipolar transistors are PNP-type bipolar transistors, and wherein the first and second MOS transistors are N-channel type MOS transistors.

7. The reference voltage generating circuit according to claim 6, wherein the junction type passive element in the output part is a diode-connected bipolar transistor in which a base terminal and a collector terminal are coupled to each other.

8. The reference voltage generating circuit according to claim 6, wherein the junction-type passive element in the output part is a PN junction diode.

9. The reference voltage generating circuit according to claim 1, further comprising a startup circuit having a function of receiving/passing current from/to the first or second resistor in the band gap part on start of operation of the reference voltage generating circuit and, after the output of the differential amplifier rises to a predetermined level, interrupting the receiving current or passing current.

10. A semiconductor integrated circuit having therein a reference voltage generating circuit according to claim 1 and an A/D converter or D/A converter, wherein voltage generated by the reference voltage generating circuit is supplied as a reference voltage to the A/D converter or D/A converter.

11. A semiconductor integrated circuit apparatus having therein a reference voltage generating circuit, wherein a reference voltage generating circuit has a band gap part and an output part, wherein the band gap part has: a first resistor and a first bipolar transistor connected in series between a first power supply voltage terminal and a second power supply voltage terminal; a second resistor, a second bipolar transistor, and a third resistor connected in series between the first power supply voltage terminal and the second power supply voltage terminal; and a differential amplifier that receives voltages generated by the first and second resistors, wherein one end of the first resistor is connected to the first power supply voltage terminal, the first bipolar transistor is connected to the second power supply voltage terminal, one end of the second resistor is connected to the first power supply voltage terminal, one end of the third resistor is connected to the second power supply voltage terminal, the second bipolar transistor is connected between the second and third resistors, wherein potential at a connection point between the first resistor and the first bipolar transistor is applied to a first input terminal of the differential amplifier circuit, potential at a connection point between the second resistor and the second bipolar transistor is applied to a second input terminal of the differential amplifier circuit, an output of the differential amplifier is applied to the bases of the first and second bipolar transistors, wherein the output part has a third bipolar transistor having a base to which the output of the differential amplifier is applied, a fourth resistor connected in series with the third bipolar transistor, a current mirror circuit for transferring current flowing in the third bipolar transistor, and a fifth resistor and a junction type passive element connected in series for converting the transferred current to voltage, wherein the differential amplifier includes, as passive elements, an N-channel type MOS transistor and a P-channel type MOS transistor, and wherein each of the first, second, and third bipolar transistors has a buried semiconductor region as a collector region and is formed as a vertical transistor in which operation current flows mainly in the direction perpendicular to a substrate, and at least an emitter region is a semiconductor region formed by the same process as a process of forming a semiconductor region as a source/drain region of the N-channel type MOS transistor or P-channel type MOS transistor.

12. The semiconductor integrated circuit apparatus according to claim 11, wherein a semiconductor region as a base region in each of the first, second, and third bipolar transistors is a semiconductor region formed by the same process as the process of forming a well region in which the source/drain region of the N-channel type MOS transistor or P-channel type MOS transistor is formed.

13. The semiconductor integrated circuit apparatus according to claim 11, wherein the first, second, and third bipolar transistors are NPN-type bipolar transistors, wherein a semiconductor region is provided as a collector pull-up region which is connected to a buried semiconductor region as the collector region of each of the first, second, and third bipolar transistors, wherein a semiconductor region as a base region in each of the first, second, and third bipolar transistors is formed by the same process as a process of forming a P-type well region in which the source/drain region of the N-channel type MOS transistor is formed, and wherein the semiconductor region as the collector pull-up region is an N-type semiconductor region formed by the same process as a process of forming an N-type well region in which the source/drain region in the P-channel type MOS transistor is formed.

14. The semiconductor integrated circuit apparatus according to claim 11, wherein the first, second, and third bipolar transistors are PNP-type bipolar transistors, wherein a semiconductor region is provided as a collector pull-up region which is connected to a buried semiconductor region as the collector region of each of the first, second, and third bipolar transistors, wherein a semiconductor region as a base region in each of the first, second, and third bipolar transistors is an N-type semiconductor region formed by the same process as a process of forming an N-type well region in which the source/drain region of the P-channel type MOS transistor is formed, and wherein the semiconductor region as the collector pull-up region is formed by the same process as a process of forming a P-type well region in which the source/drain region in the N-channel type MOS transistor is formed.

15. The semiconductor integrated circuit apparatus according claim 11, wherein a semiconductor region formed by the same process as that of a buried semiconductor region as a collector region of the bipolar transistor is provided between a well region in which the source/drain region of each of the N-channel type MOS transistor and the P-channel type MOS transistor is formed and a semiconductor substrate.

16. The semiconductor integrated circuit apparatus according claim 11, wherein the first to fifth resistors are made by a conductive layer formed over an insulating film on one of faces of a semiconductor substrate, and the conductor layer is made of the same material as that of a conductive layer of the gate electrodes of the N-channel type MOS transistor and the P-channel type MOS transistor.

* * * * *